US005266063A

United States Patent [19]

Baumgartner, Jr.

[11] Patent Number: 5,266,063

[45] Date of Patent: Nov. 30, 1993

[54] SPINNING LIGHT DEVICE

[76] Inventor: William J. Baumgartner, Jr., 2844 Old Washington Rd., Westminster, Md. 21157

[21] Appl. No.: 42,047

[22] Filed: Apr. 2, 1993

[51] Int. Cl.[5] ..... A63H 33/26

[52] U.S. Cl. ..... 446/242; 446/485; 362/198

[58] Field of Search ..... 446/242, 485, 484; 362/198, 811

[56] References Cited

U.S. PATENT DOCUMENTS

| | | | |
|---|---|---|---|
| 2,467,954 | 4/1949 | Becker | 362/198 |
| 3,325,940 | 6/1967 | Davis | 446/242 |
| 3,737,722 | 6/1973 | Scharlack | 362/198 X |

*Primary Examiner*—Mickey Yu
*Attorney, Agent, or Firm*—Walter G. Finch

[57] ABSTRACT

The present invention is a spinning light device. The device primarily consists of a metallic battery case, a hard wire coil, and a number of insulated wires, light bulb sockets, and light bulbs. When the device is turned on by means of a switch, the user simply grasps the device by the metallic battery case and whirls the attached lights about in circular or other motions. The effect is to produce a trail of light behind the moving light bulb or bulbs. A sparkling effect may be added to the whirling of the illuminated device by attaching either a tinsel wrap or another reflective material to the hard wire coil.

6 Claims, 3 Drawing Sheets

SPINNING LIGHT DEVICE

BACKGROUND OF THE INVENTION

This invention relates to toys, and more particularly, to an electric spinning light device for use as a toy.

For years, children have been fascinated with toys having illuminating features. On certain holidays, such as New Year's Eve and the Fourth of July, celebrating with extremely loud and bright fireworks and other devices is perfectly acceptable. Yet, in many states, the use of pyrotechnics has become prohibited by law.

The present invention, therefore, provides a safe, legal, and inexpensive spinning light toy which, when decorated with a tinsel wrap, produces a sparkling effect upon being whirled about in circular or other motions.

BEST KNOWN PRIOR ART

The best known prior U.S. art is as follows:

U.S. Pat. No. 2,726,483
U.S. Pat. No. 2,841,922
U.S. Pat. No. 3,037,322
U.S. Pat. No. 4,886,687
U.S. Pat. No. 5,073,139

The prior art accounts for many inventions which serve as light emitting, amusement devices. The Hughes et al. U.S. Pat. No. 2,726,483 teaches a flashing toy in which a rotor carries a figure which intermittently flashes as the rotor is turned. A rotatable, electronic noise making device with light emitting means for use during holidays such as Halloween, New Year's Eve, anniversaries, and the Fourth of July is the subject of the Kassarich U.S. Pat. No. 5,073,139. The design of the Kassarich invention is consistent with that of traditional noise-making devices used to drown-out the name of 'Hyman' during the reading of the Book of Ester, a ceremony which occasionally takes place as part of the Jewish faith. The U.S. Pat. No. 2,841,922 issued to Kolintzas describes an illuminated toy having a round, central portion connected on both sides to string means in such a manner that, when the twisted string means is pulled taut, the round central portion spins and a light connected thereon flashes intermittently.

The Malott U.S. Pat. No. 4,886,687 teaches a hand-held device consisting of a handle and a number of light diffracting strips. In operational use, the Malott invention simulates a sparkler, and can be used for either amusement or warning. By diffracting ambient light, the Malott device produces a dynamic display of clearly separated colors which is unique to other similar light reflecting devices.

My earlier invention, the Baumgartner, Jr. U.S. Pat. No. 3,037,322, also sought to provide a spinning light toy device. The previous invention could be used in place of sparklers to provide a similar sparkling effect. This prior whirling light toy comprised a handle and a pair of swingable leads having a number of lights connected thereon. The lights erratically blinked on and off as the swingable leads, each loosely connected to one of two commutating slip rings, rotated about a rod extending from the handle.

The present invention seeks to provide a similar light top as did my previous device, but with an improved and simplified design. Having far fewer parts and a simplified design, the present spinning toy device is much less expensive to manufacture than the prior whirling light toy.

OBJECTS OF THE INVENTION

It is an object of this invention to provide a novel, spinning light toy which is safe and legal in use, inexpensive to purchase, and easy to manufacture.

Another object of this invention is to provide an electrically lighted, spinning toy that may be decorated with a metallic or mylar type of tinsel wrap, or with another suitable material, in order to enhance the sparkling effect as the toy is whirled about in circular motions.

And to provide a unique, spinning light toy that is simple in design and dependable in operational use is still another object of this invention.

BRIEF DESCRIPTION OF THE DRAWINGS

These and other objects and attendant advantages of this invention will become more obvious and understood from the following detailed specification and accompanying drawings, in which.

DESCRIPTION OF THE PREFERRED EMBODIMENTS OF THE INVENTION

Figure 1:
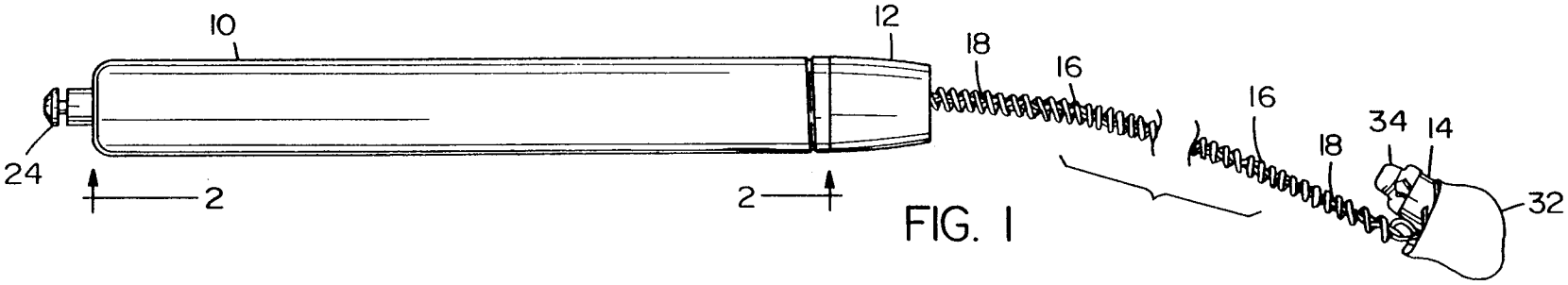
FIG. 1 is an actual size, elevational view of a spinning light device incorporating novel features of this invention.

Referring now to FIGS. 1 to 7 of the drawings, there is shown the preferred embodiment of an electrically illuminated, spinning device embodying novel principles of this invention. The device consists of a metal battery case 10, a hard wire coil 16, one or more insulated wires 18, and a light socket 14 having a light bulb 34 threaded therein.

Figure 2:
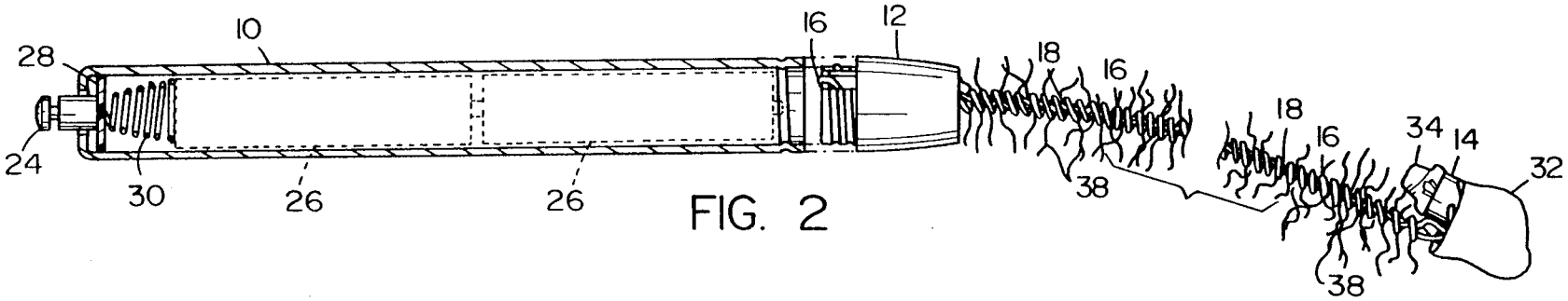
FIG. 2 is an actual size, partially cross-sectioned, elevational view of the spinning light device of FIG. 1 having a first reflective means attached thereto.
Figure 3:
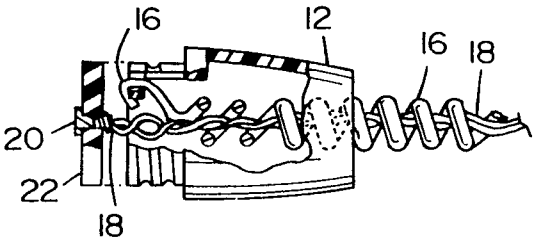
FIG. 3 is an enlarged view, partially in cross-section, of the apertured cap member and hard wire coil/insulated wire assembly of the spinning light device of FIG. 1.

The inner portion of the metal battery case 10, seen in detail in FIG. 2, holds two batteries 26 which serve as the power supply for the device. The upper end of the metal battery case 10 is internally threaded to receive an externally threaded, apertured cap 12. The apertured cap 12, seen in great detail in FIG. 3, is made from a plastic or other insulating material. When threaded upon the metal battery case 10, the apertured cap 12 keeps the batteries 26 firmly positioned between a first spring 30 resting on top of a stationary insulating washer 28 at the lower end of the battery case 10, and an electric contact 20 fixed to the lower portion of the apertured cap 12. In this manner, the first spring 30, the batteries 26, and the electric contact 20 all become electrically connected in series.

The lower end of the metal battery case 10 is equipped with a sliding, metal switch 24 which passes through an opening in the bottom surface of the battery case 10. The switch 24 is urged outward by means of a second spring (not shown). When the metal switch 24 is depressed inwardly, it makes contact with the first spring 30. The metal switch 24 may be locked into an inward position against the first spring 30 by tilting the switch 24 so that a portion of the lip of the round opening in the battery case 10 through which the switch 24 passes mates into the round groove found in the lower end of the switch 24. When the switch 24 is locked into this position, the metal battery case 10, the metal switch 24, the first spring 30, the batteries 26, and the electric contact 20 of the apertured cap 12 all become electrically connected in series.

The rest of the electrical circuit is completed from the apertured cap 12 and above. With respect to FIG. 3, the apertured cap 12 is seen to have a hard wire coil 16 both connected to its lower threaded portion, and passing upwardly through its opening. The hard wire coil 16, as it is attached to the apertured cap 12, is rigidly held into place at the point of connection. Since a portion of the hard wire coil 16 is wrapped around a section of the threaded portion of the apertured cap 12, the hard wire coil 16 is brought into contact with the metal battery case 10 when the apertured cap 12 is threaded onto the case 10. The connection of the hard wire coil 16 to the threaded portion of the apertured cap 12 is seen in FIG. 3.

Still referring to FIG. 3, two intertwined, insulated wires 18 are joined to the top surface of the electric contact 20 of the apertured cap. These insulated wires 18 extend upwardly through the longitudinal opening provided in the center of the hard wire coil 16. The connection of the insulated wires 18 to the electric contact 20 is shielded from the hard wire coil 16 by means of a flat insulating washer 22.

Figure 4:
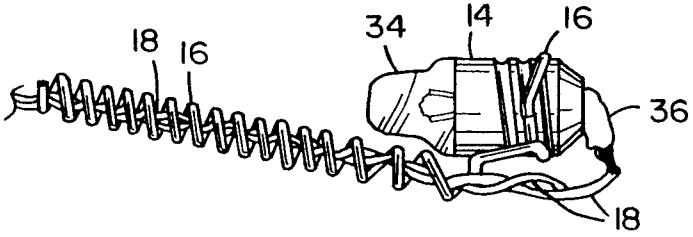
FIG. 4 is an enlarged view of the upper portion of the spinning light device of FIG. 1, showing in great detail the light bulb, socket, and wiring connection.

With respect to FIG. 4, the hard wire coil 16 and insulated wires 18 are joined to a light bulb socket 14. The hard wire coil 16 is wrapped around the threaded portion of the socket 14, and thereby comes into contact with one of the two terminals provided on the socket 14. The two insulated wires 18 are both joined to the other of the two terminals provided on the socket 14 by means of a soldered connection 36. A light bulb 34 is threaded into the bulb socket 14. All electrical connections around the socket 14 may be protected with an insulating cover 32, as seen in FIGS. 1 and 2.

As illustrated in FIGS. 1, 2, and 4, the toy device may be complete with one light bulb 34. Yet, any reasonable number of light bulbs 34 may be included on the device. For example, three light bulbs 34 may be arranged along the hard wire coil 16 so that the threaded portion of each light bulb socket 14 comes into contact with the hard wire coil 16. This would provide a common connection for each light bulb socket 14. Next, either three individual insulated wires 18 each connected to the electric contact 20 would be soldered to the second terminal of the three respective light bulb sockets 14 (one wire 18 per socket 14), or one wire connected to the electric contact 20 would be first soldered to the second terminal of the lowest light bulb socket 14, then further extend upwardly and be soldered to the second terminal of the middle light bulb socket 14, and finally, extend even further upwardly to its final point where it would be soldered to the second terminal of the highest socket 14. In this either of the two latter arrangements, the three light bulbs 34 and sockets 14 would be electrically connected in parallel with respect to the batteries 26. Therefore, each light bulb 34 would receive the full amount of electric current to illuminate its respective filament.

Figure 5:
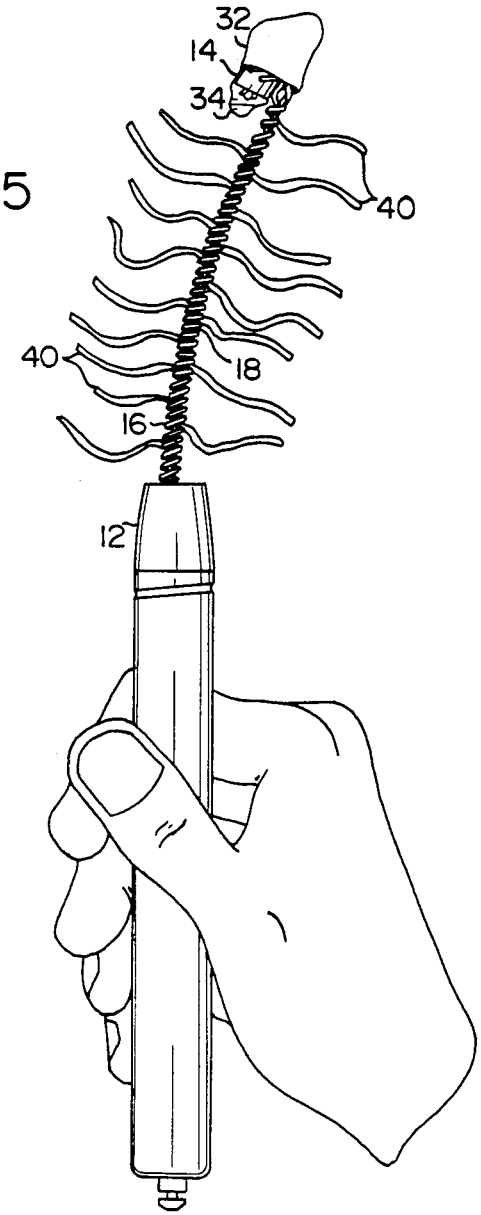
FIG. 5 is an actual size elevational view of the spinning light device of FIG. 1 illustrating how the device is held, the upper portion of the device having a second reflective means attached thereto.
Figure 6:
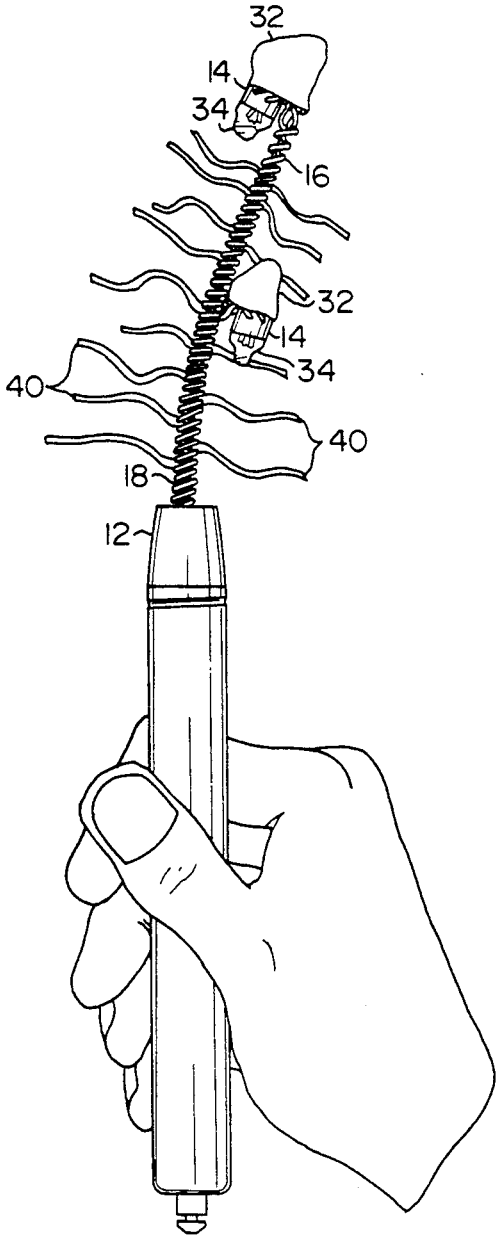
FIG. 6 is an actual size elevational view of the spinning light device of FIG. 1 also illustrating how the device is held, the upper portion of the device depicting multiple light bulbs and having a second reflective means attached thereto.

FIGS. 5 and 6 illustrate how the device is held. FIG. 5 shows the device with one light bulb 34, and FIG. 6 depicts the device with two light bulbs 34. During operation, the visual effect produced by the device may be enhanced by attaching a first tinsel wrap 38 to the hard wire coil 16 of the device. This first tinsel wrap 38, seen in FIG. 2, will result in a sparkling effect as the device is whirled about. A second tinsel wrap 40, having larger strands, may also be attached to the device. As seen in FIGS. 5 and 6, this second tinsel wrap 40 will produce a similar sparkling effect as will the first tinsel wrap 38, the choice of which to use dependent on the preference of the user of the device.

When the metal switch 24 is depressed inwardly, the electrical circuit becomes closed, and the light bulb or bulbs 34 attached to the hard wire coil 16 and insulated wires 18 illuminate. The energizing path of electricity flow begins at the positive pole of the power supply, where the electric contact 20 touches the top battery 26. Electricity courses through the contact 20, and upwardly through the insulated wires 18. The electric current then enters the light bulb sockets 14 through the soldered connections 36, passes through the filaments in the respective light bulbs 34, and flows back out through the threaded portions of the sockets 14. The current then travels downwardly through the hard wire coil 16, into the metal battery case 10, through the metal switch 24, into the first spring 30, and finally, into the negative pole of the lower battery 26. Since both the hard wire coil 16 and the battery case 10 conduct electric current in the same direction, no short circuiting will occur if the hard wire coil 16 is bent back so as to touch the metal battery case 10.

Once the switch 24 is depressed and the light bulb or bulbs 34 are illuminated, the user of the device simply holds the toy by grasping the battery case 10 and proceeds to whirl the attached light bulb or bulbs 34 about in circular or other motions. The effect will be to produce a pleasing trail of light. During whirling, the hard wire coil 16 allows the light bulb or bulbs 34 to travel about in a controlled manner by providing the insulated wires 18 with a fair degree of rigidity. A sparkling effect may be added to the spinning of the illuminated device by attaching a portion of a first tinsel wrap 38, a second tinsel wrap 40, or another reflective decoration to the hard wire coil 16.

Figure 7:
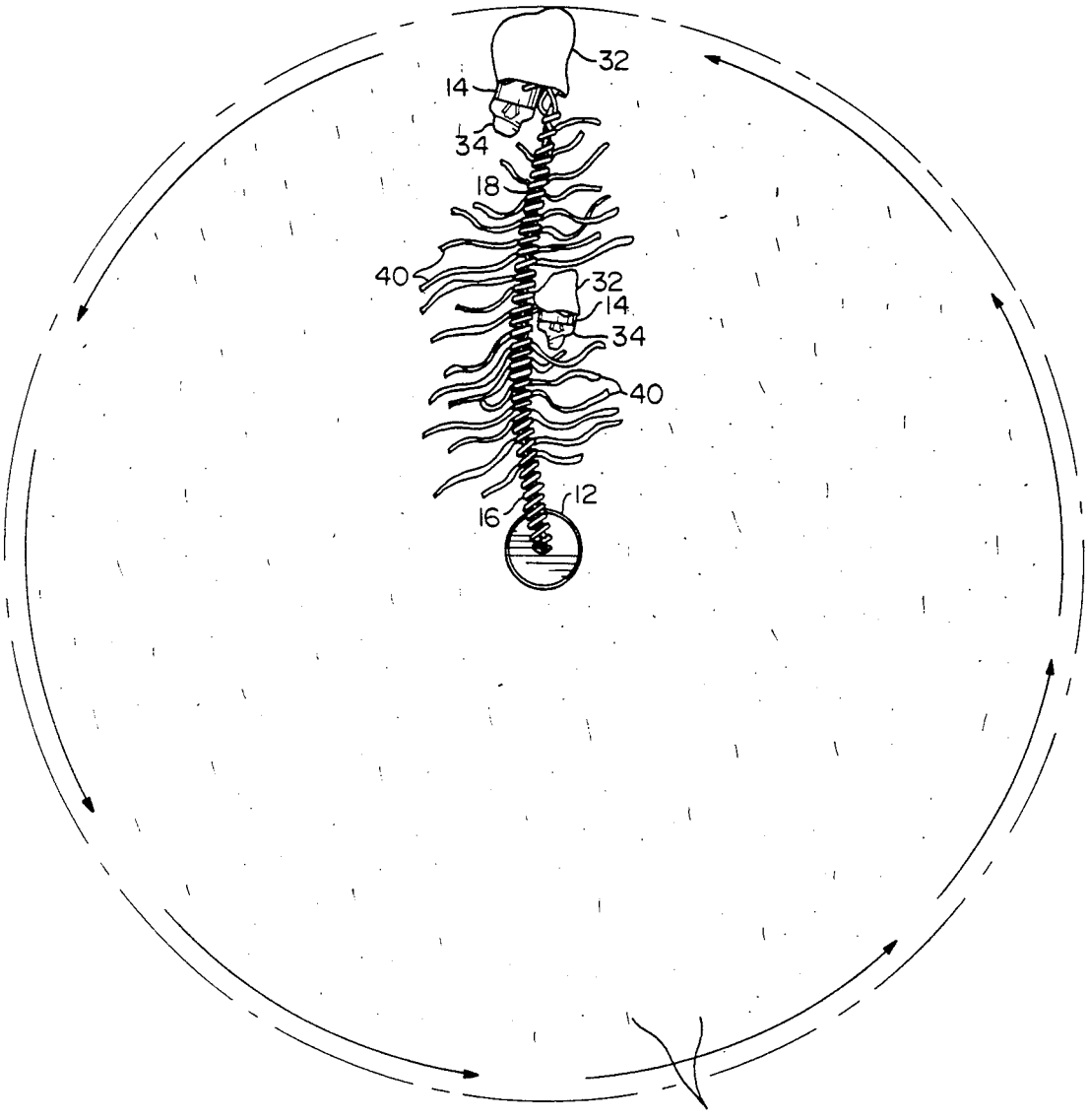
FIG. 7 is a top view of the spinning light device of FIG. 1 illustrating the sparkling effect produced as the device is whirled about in circular motions.

FIG. 7 is a top view of the device as it is being whirled about in circular motions. By reflecting light emitted from two light bulbs 34, the second tinsel wrap 40 attached to the device produces a number of visually pleasing sparkles.

It should be clear that the invention is not limited to the previous descriptions and drawings, which merely illustrate the preferred embodiment. Slight departures may be made within the present scope of the invention. For example, the battery case 10 may be designed to house four batteries 26 instead of two, or the hard wire coil 16 may be thermally attached to the apertured cap 12, rather than being wrapped there around. Therefore, the scope of the invention is meant to embrace any and all equivalent apparatus, as well as all design alterations, included in the appended claims.

What is claimed is:

1. An electrically illuminated, spinning light device, comprising:

structure defining a metallic battery case and forming a handle, said metallic battery case having an insulated apertured cap;

a hard wire coil in the form of a long spring, said hard wire coil extending through an opening provided in said apertured cap, said hard wire coil attached to said apertured cap so that said hard wire coil makes contact with said metallic battery case when said apertured cap is attached to said battery case, said hard wire coil joined to the first of two terminals provided on a number of light bulb sockets;

a number of insulated wires connected to an electric contact within said apertured cap, said insulated wires extending through a central longitudinal opening provided in said hard wire coil, said insulated wires joined to the second of said two terminals provided on said light bulb sockets;

an electrical circuit including a source of power and a switch therefor; and a number of light bulbs joined to said light bulb sockets.

2. An electrically illuminated, spinning light device as recited in claim 1, wherein said source of power is two batteries.

3. An electrically illuminated, spinning light device as recited in claim 1, wherein a spring resting on a stationary washer in the lower portion of said metallic battery case keeps a number of batteries contained within said battery case firmly positioned between said spring and said apertured cap.

4. An electrically illuminated, spinning light device, comprising:

structure defining a metallic battery case and forming a handle, said metallic battery case having an insulated apertured cap;

a hard wire coil in the form of a long spring, said hard wire coil extending through an opening provided in said apertured cap, said hard wire coil attached to said apertured cap so that said hard wire coil makes contact with said metallic battery case when said apertured cap is attached to said battery case, said hard wire coil joined to the first of two terminals provided on a number of light bulb sockets;

a number of insulated wires connected to an electric contact within said apertured cap, said insulated wires extending through a central longitudinal opening provided in said hard wire coil, said insulated wires joined to the second of said two terminals provided on said light bulb sockets;

an electrical circuit including a source of power and a switch therefor;

a number of light bulbs joined to said light bulb sockets;

reflective means attached to said hard wire coil to produce a sparkling effect when said spinning light toy is whirled about; and an insulating cover means for all electrical connections on said light bulb sockets.

5. An electrically illuminated, spinning light device as recited in claim 4, wherein said source of power is two batteries.

6. An electrically illuminated, spinning light device as recited in claim 4, wherein a spring resting on a stationary washer in the lower portion of said metallic battery case keeps a number of batteries contained within said battery case firmly positioned between said spring and said apertured cap.

* * * * *